US005997207A

United States Patent [19]

Robinson

[11] Patent Number: 5,997,207

[45] Date of Patent: Dec. 7, 1999

[54] SHEET ASSEMBLY WITH AN OPTIONAL POCKET

[75] Inventor: E. Montgomery Robinson, Chattanooga, Tenn.

[73] Assignee: Top Flight, Inc., Chattanooga, Tenn.

[21] Appl. No.: 09/139,630

[22] Filed: Aug. 25, 1998

[51] Int. Cl.[6] ..... B42F 13/00

[52] U.S. Cl. ..... 402/79; 281/37; 281/31; 281/38

[58] Field of Search ..... 281/15.1, 22, 28, 281/29, 31, 37, 45

[56] References Cited

U.S. PATENT DOCUMENTS

| | | | |
|---|---|---|---|
| 1,495,953 | 5/1924 | Dick . | |
| 1,524,647 | 2/1925 | Albrecht . | |
| 2,879,774 | 3/1959 | Siegel | 129/20 |
| 4,519,629 | 5/1985 | Podosek | 281/25 |
| 4,848,798 | 7/1989 | Moor | 281/31 |
| 5,042,841 | 8/1991 | Friedman | 281/29 |
| 5,125,561 | 6/1992 | Idstein | 402/79 |
| 5,782,349 | 7/1998 | Combs | 206/308.1 |
| 5,806,894 | 9/1998 | Dottel | 402/79 X |

*Primary Examiner*—Willmon Fridie, Jr.
*Attorney, Agent, or Firm*—Luedeka, Neely & Graham PC

[57] ABSTRACT

A sheet assembly is described that provides a storage pocket. In one embodiment, the assembly offers a consumer the choice of making the pocket or leaving the pocket inaccessible. That embodiment of the assembly comprises a front and back sheet bonded along portions of two edges and the back sheet includes a tear line. A removable flap is formed in the back sheet by the tear line, and a user can access the pocket by tearing the back sheet along the tear line to remove the flap. The assembly can be expanded into various notebook geometries, which are also described. Whether the user decides to form the pocket or not, the assembly provides a double-stiff cover for the notebook. In another embodiment, a recess is provided in the back sheet instead of a removable flap.

A method for making the sheet assembly is also described. The method allows the assembly to include a storage pocket and also allows several assemblies to be produced quickly, inexpensively, and contemporaneously, thereby providing consumers with a low-cost notebook having a storage pocket. The methods of making the assemblies that have been expanded into various notebook geometries are also described.

20 Claims, 5 Drawing Sheets

SHEET ASSEMBLY WITH AN OPTIONAL POCKET

TECHNICAL FIELD

The present invention relates to notebooks and containers used to store loose leaf paper. More particularly, this invention relates to storage pockets formed by the cover of a notebook and wire bound or padded school and stationary products.

The present invention also relates to a method for making containers used to store loose leaf paper. More particularly, this invention relates to a method for making storage pockets used in wire bound and padded school and stationary products.

BACKGROUND OF THE INVENTION

Notebooks have previously either provided consumers with no pockets or have provided pockets created by folds that cause a substantial increase in the price. Also, the previous notebooks providing pockets typically have not given the consumer a choice or flexibility as to how or whether the pocket is formed. If the consumer chose to purchase a notebook without a pocket and later decided a pocket was necessary, the consumer had to purchase an add-on pouch to supplement the notebook. A relatively inexpensive notebook that provides the consumer with a choice of pocket configuration is needed. The present invention fulfills that need.

Producing notebooks with pockets has previously been a slow, high-cost process. The notebooks were produced by taking an individual blank for each notebook, folding it, and gluing the overlapping side edges. This process results in too much time being used per notebook produced and requires too much expense to properly create, fold, and glue the blank. The resulting notebook has a substantial increase in price over a notebook without a pocket and takes much longer to produce. A quick, inexpensive method is needed to produce notebooks having pockets requiring only an insubstantial increase in price and time expended. The present invention also fulfills that need.

SUMMARY OF THE INVENTION

The present invention provides a low cost sheet assembly including a storage pocket and various notebook geometries that the sheet assembly can form. The sheet assembly includes a rectangularly shaped front sheet of rigid material and a rectangularly shaped back sheet of rigid material. In one embodiment, a tear line extends from a point on an edge of the back sheet, into an interior portion of the back sheet, and terminates at another point on an edge of the back sheet. A removable flap is formed in the back sheet by the tear line. A pocket is formed by the front sheet and a portion of the back sheet. The pocket includes that portion of the back sheet disposed on the opposite side of the tear line from the flap so that the pocket may be further formed by a user or the manufacturer of the sheet assembly tearing the back sheet along the tear line and removing the flap from the back sheet. A bonded left (vertical) edge is formed by an adhesive disposed in a generally elongate rectangular strip positioned parallel and adjacent to the left edges of the front and back sheets, between the front and back sheets, and on the opposite side of the tear line from the flap. A bonded bottom (horizontal) edge is formed by an adhesive disposed in a generally elongate rectangular strip positioned parallel and adjacent to the left edges of the front and back sheets, between the back surface of the front sheet and the front surface of the back sheet, and on the opposite side of the tear line from the flap. The pocket is then formed between the bonded left and bottom edges and the tear line. In another embodiment, the back sheet includes a recess rather than a removable flap, and the pocket is accessible without further action by the user or manufacturer.

The sheet assembly can also include a set of rectangularly shaped stacked pages of a flexible material. A means for binding the front sheet, the back sheet, and the set of pages together is also included. One embodiment includes the binding means positioned on the right edges of the front sheet, the back sheet, and the set of pages, and another embodiment includes the binding means positioned on the top edges instead.

In a preferred embodiment, the front sheet, back sheet, and set of pages have linear arrangements of holes substantially parallel and proximate to their right edges. The left edge of the back sheet is bonded from a point proximate to the bottom edge to a point approximately halfway between the top and bottom edge. The tear line extends linearly from a point on the left edge just above the adhesive to the corner between the top edge and the right edge. The means for binding the assembly includes a wire that is spiraled through the linear arrangement of holes in the front sheet, the back sheet, and the set of pages.

The present invention also provides a method for making the sheet assembly and the various notebook geometries the sheet assembly can form. The method includes depositing on a front surface of a large bottom sheet of rigid material a plurality of spaced-apart, substantially parallel, horizontal glue strips extending between the vertical edges of the bottom sheet. A plurality of vertical glue strips are deposited on the front surface of the bottom sheet and are spaced-apart, substantially parallel, and extend between the horizontal edges of the bottom sheet. A rear surface of a large top sheet of rigid material is bonded to the front surface of the bottom sheet by contacting the rear surface of the top sheet to the horizontal and vertical glue strips. The large bonded top and bottom sheets are cut horizontally and vertically to produce a plurality of small joined rectangular sheet pairs. The cutting step includes cutting vertically proximate to the vertical glue strips and horizontally below the horizontal glue strips. Each small sheet pair produced has a small front sheet, a small back sheet, a horizontal glue strip bonding a horizontal edge, and a vertical glue strip bonding a vertical edge. A tear line is created in each small back sheet by beginning each tear line at a point with no glue on an edge of each back sheet. The tear line is further created by extending each tear line into an interior portion of each back sheet, and terminating each tear line at a point with no glue on an edge of each back sheet. Each tear line forms a removable flap in each small back sheet. The bonded edges and the tear line in each small sheet pair form a pocket within each small sheet pair. One embodiment also includes removing the flap from the sheet pair.

The method for making the sheet assembly can also include forming a set of rectangularly shaped stacked pages of a flexible material. The front sheet, the back sheet, and the set of pages are bound together along an edge of each page, an edge of the front sheet, and an edge of the back sheet not forming a part of the flap.

In a preferred embodiment, the large top and bottom sheets have identical dimensions. Also, a glue pattern machine is used to deposit the horizontal glue strips and the vertical glue strips on the large bottom sheet. A die press is used to create the tear lines in each back sheet. The die press can also be used to remove the flap from the back sheet.

BRIEF DESCRIPTION OF THE DRAWINGS

The invention is described in more detail in the following with reference to the accompanying drawings in which.

DETAILED DESCRIPTION OF THE PREFERRED EMBODIMENTS

Figure 1:
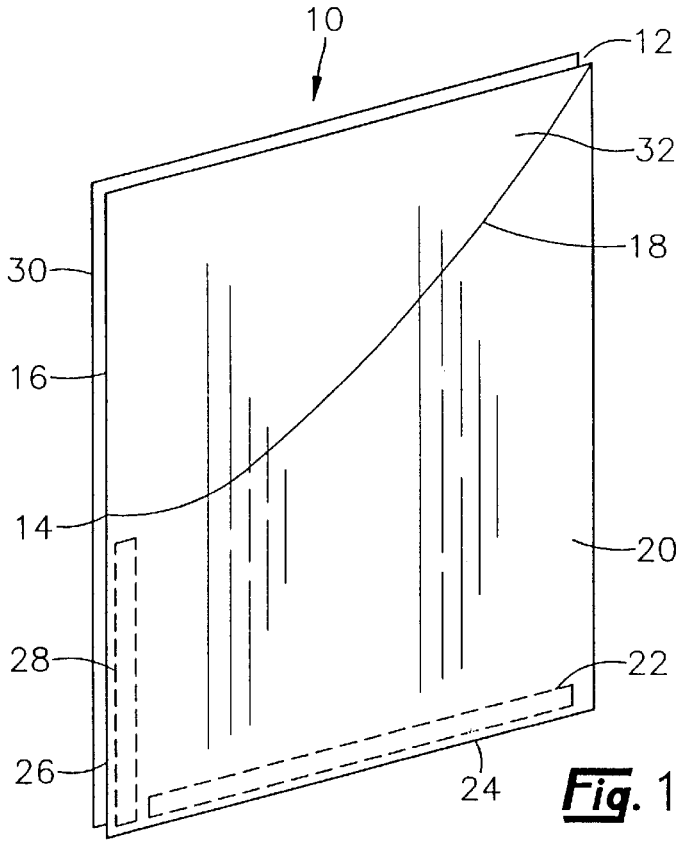
FIG. 1 is a front perspective view of the sheet assembly with the pocket not yet formed by the user or manufacturer.

FIG. 1 is a perspective view of a sheet assembly 10 including a front rectangular sheet 30, a back rectangular sheet 20 flush with the front sheet 30, and a tear line 18 in the back sheet 20. Back sheet 20 appears to be shifted from front sheet 30 slightly, but the sheets are shown this way only to permit both to be seen. For all of the embodiments, the sheets are flush. The tear line 18 extends from a corner 12 to a point 14 on an opposing edge 16 of the back sheet 20, and a removable flap 32 (the upper left corner of sheet 20) is formed by the tear line 18. The front sheet 30 and the back sheet 20 can be formed from cardboard or other appropriate material but preferably from index cover stock. In this embodiment, the back sheet 20 must be made from a material that allows a tear line 18 to be created therein. The tear line 18 can be a perforation or any other suitable line that sufficiently provides a weakened portion in the back sheet 20 such that a user or the manufacturer could tear the back sheet 20 along the weakened portion. The sheet assembly 10 has a bonded left edge 26 formed by an elongate strip of adhesive 28 substantially parallel and proximate to left edge 26. The sheet assembly 10 also has a bonded bottom edge 24 formed by an elongate strip of adhesive 22 substantially parallel and proximate to the bottom edge 24. The adhesive strips 28 and 22 can be any type of adhesive that is known to bond to the type of material used to form the front sheet 30 and the back sheet 20.

Figure 2:
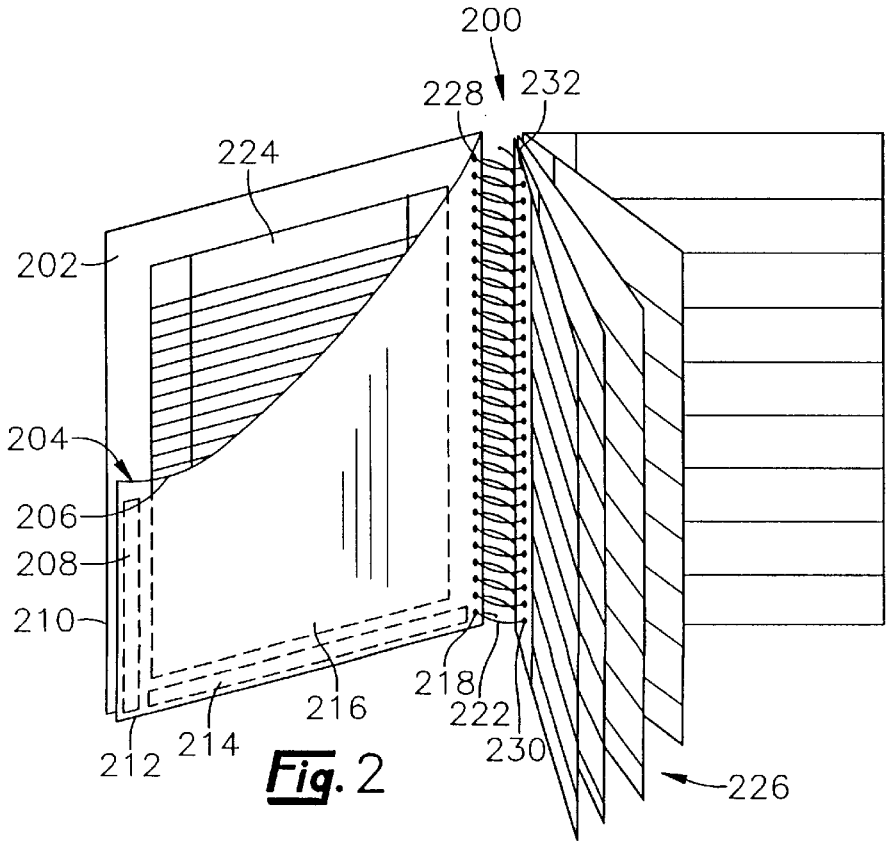
FIG. 2 is a front perspective view of the sheet assembly in another embodiment with the pocket in use.

FIG. 2 is a perspective view of a different embodiment of a sheet assembly 200. This view shows the pocket 204 that has been formed by removing that portion (the upper left corner) of the back sheet 216 that is not bonded to the front sheet 202 and is disposed on the opposite side of the tear line 206 from that portion of the back sheet 216 that is bonded to the front sheet 202. The pocket 204 is formed by the front sheet 202, the back sheet 216, and the tear line 206. The pocket is formed between the bonded left edge 210, formed by adhesive strip 208, the bonded bottom edge 212, formed by adhesive strip 214, and the tear line 206. Adhesive strip 208 is substantially parallel and proximate to left edge 210. Adhesive strip 214 is substantially parallel and proximate to the bottom edge 212. The pocket 204 is storing a piece of paper 224. A set of pages 226 is included in the sheet assembly 200 such that when closed, the sheet assembly 200 has the front sheet 202 flush with the back sheet 216, and the back sheet 216 flush with the set of pages 226. A wire 222 is being used to bind the front sheet 202, the back sheet 216, and the set of pages 226 along edge 228 of the front sheet 202 and back sheet 216 and edge 232 of the set of pages 226. The wire 222 is spiraled into a position within a linear arrangement of holes 218 in the front sheet 202 and the back sheet 216. The linear arrangement of holes 218 is substantially parallel and proximate to the right edge 228 of the front sheet 202 and back sheet 216. The wire 222 is positioned within a linear arrangement of holes 230 in the set of pages 226 as well. The linear arrangement of holes 230 in the set of pages 226 is substantially parallel and proximate to the right edge 232 of the set of pages 226. FIG. 2 can also be representative of another embodiment that has a recess rather than a removable flap, and the recess would be defined by the tear line 206 which would be a normal edge instead of a tear line in that embodiment.

Figure 3:
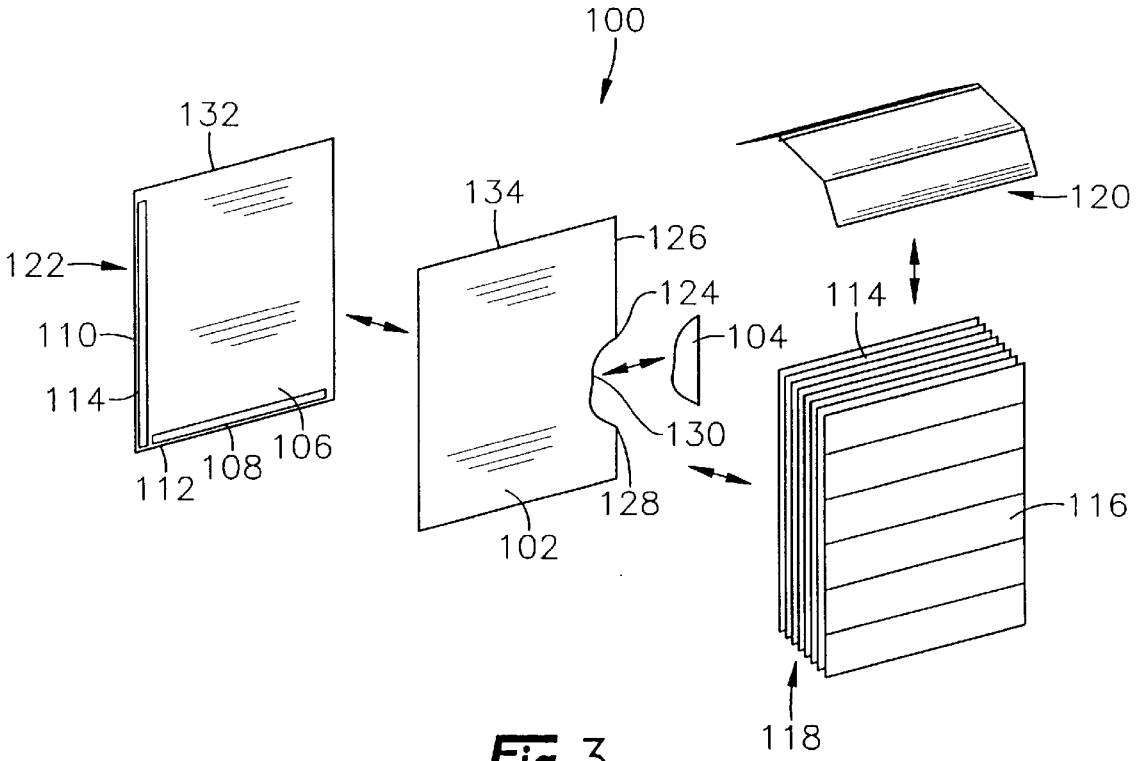
FIG. 3 is an exploded view of the sheet assembly in another embodiment with the flap removed.

FIG. 3 is an exploded view of another embodiment of the sheet assembly 100. A rectangularly shaped front sheet 106 has a generally elongate rectangular strip of adhesive 114 parallel and adjacent to the left edge 110. The front sheet 106 also has an adhesive strip 108 parallel and adjacent to the bottom edge 112. A rectangularly shaped back sheet 102 has a tear line 130 that extends inwardly from one point 124 on the right edge 126 of back sheet 102 to another point 128 on the right edge 126. A removable flap 104 has been removed from the back sheet 102 by tearing the back sheet 102 along the tear line 130. A set of pages 118 can be included in the sheet assembly 100. A tape strip 120 is included to bind the front sheet 106, the back sheet 102, and the set of pages 118. The tape strip 120 is bonded to a portion of the front surface 122 of the front sheet 106, extended along a portion of the top edge 132 of the front sheet 106 and the top edge 134 of the back sheet 102, across and bonded to a portion of the top edge 114 of the set of pages 118, and bonded to a portion of the back surface 116 of the set of pages 118. With the sheet assembly 100 in a closed position, front sheet 106 is flush with back sheet 102 which is flush with the set of pages 118.

Figure 4A:
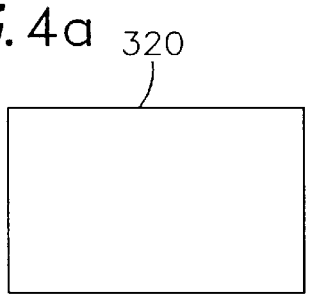
FIGS. 4*a–f* show a schematized plan view of the stages of the method.

FIGS. 4*a–f* show the stages of an embodiment of the method. The particular order of the stages is not critical to the invention. FIG. 4*a* shows a large bottom sheet 320 of rigid material, such as cardboard. In FIG. 4*a*, the large bottom sheet 320 has not yet been acted upon.

Figure 4B:
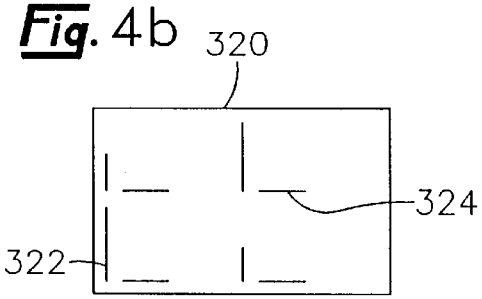

FIG. 4*b* shows the large bottom sheet 320 after a plurality of spaced-apart, substantially parallel, horizontal glue strips 324 have been deposited on the front surface of the large bottom sheet 320. The horizontal strips 324 extend between the vertical edges of the bottom sheet, but do not necessarily extend from one vertical edge to the other vertical edge. A single horizontal strip 324 can extend from one vertical edge to the other vertical edge depending on the particular geometry of the sheet assembly desired. FIG. 4*b* also shows the large bottom sheet 320 after a plurality of spaced-apart, substantially parallel, vertical glue strips 322 have been deposited on the front surface of the large bottom sheet 320. The vertical strips 322 extend between the horizontal edges of the large bottom sheet 320, but do not necessarily extend from one horizontal edge to the other horizontal edge. A single vertical strip 322 can extend from one horizontal edge to the other horizontal edge depending on the particular geometry of the sheet assembly desired.

Figure 4C:
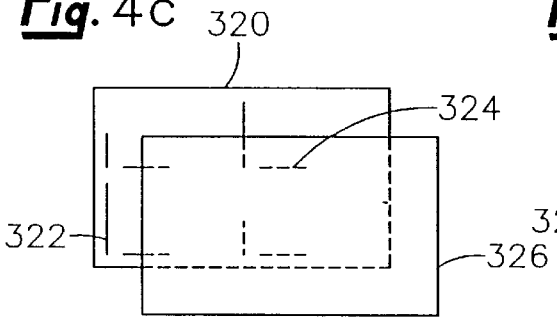

FIG. 4*c* shows the large top sheet 326 coming into contact with the adhesive strips 322 and 324 on the large bottom sheet 320 thereby bonding sheet 320 to sheet 326 with sheet 326 being flush with sheet 320.

Figure 4D:
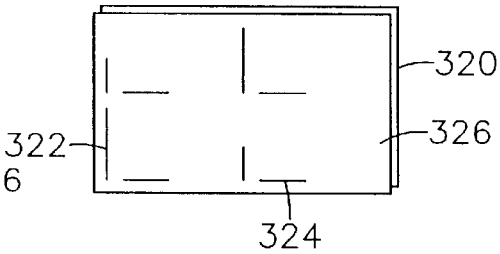

FIG. 4*d* shows the large bonded top and bottom sheets 326 and 320 and the horizontal and vertical glue strips 324 and 322 once the bonding is complete.

Figure 4E:
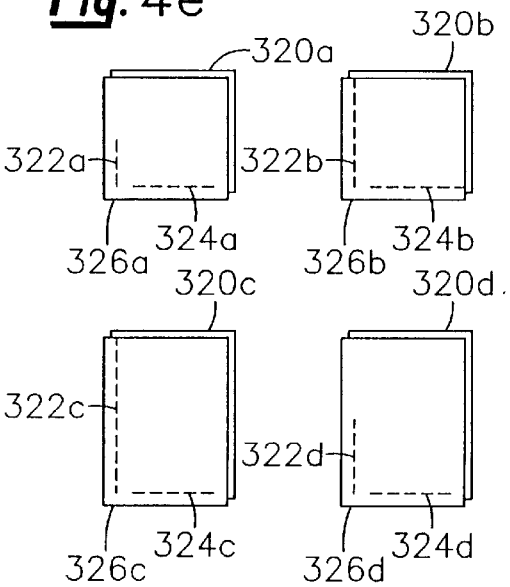

FIG. 4*e* shows the large bonded top and bottom sheets 326 and 320 from FIG. 4*d* after horizontal and vertical cuts have been made thereby producing a plurality of small joined rectangular sheet pairs. The cutting step includes cutting vertically proximate to the vertical glue strips 322*a–d*, and cutting horizontally below the horizontal glue strips 324*a–d*. Each small sheet pair has a small front sheet 326*a–d* and a small back sheet 320*a–d*. Each small sheet pair also has a horizontal glue strip 324*a–d* bonding a horizontal edge and a vertical glue strip 322*a–d* bonding a vertical edge.

Figure 4F:
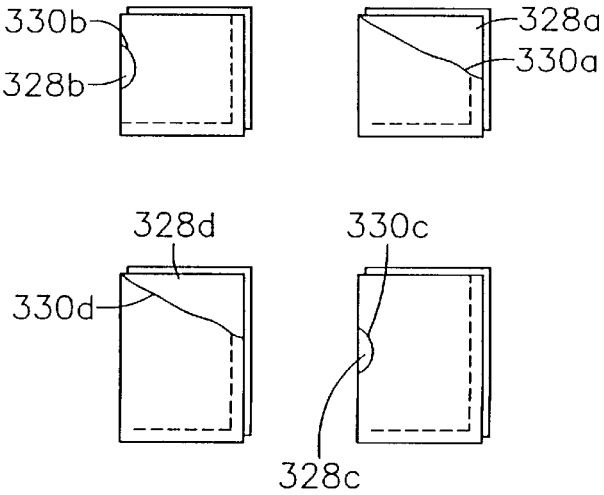

FIG. 4*f* shows the plurality of small sheet pairs after a tear line 330*a–d* and a removable flap 328*a–d* have been created in each small back sheet. The tear line begins at a point with no glue on an edge of each back sheet, extends into an interior portion of the back sheet, and terminates at another point with no glue on an edge of each back sheet. The horizontal bonded edges 324*a–d* and the vertical bonded edges 322*a–d* from FIG. 4*e*, and the tear lines 330*a–d* from FIG. 4*f* form a pocket in each small sheet pair. In one embodiment, flaps 328*a–d* are then removed from each small back sheet 320*a–d*.

The plurality of small sheet pairs can then be bound with a set of pages either along a horizontal edge that is not bonded or a vertical edge that is not bonded, depending on the particular geometry of the sheet assembly desired. Spiral wire binding can be used as well as tape strip binding or any other suitable binding method. The removable flap must remain unbound or be able to be removed from the binding.

Figure 5A:
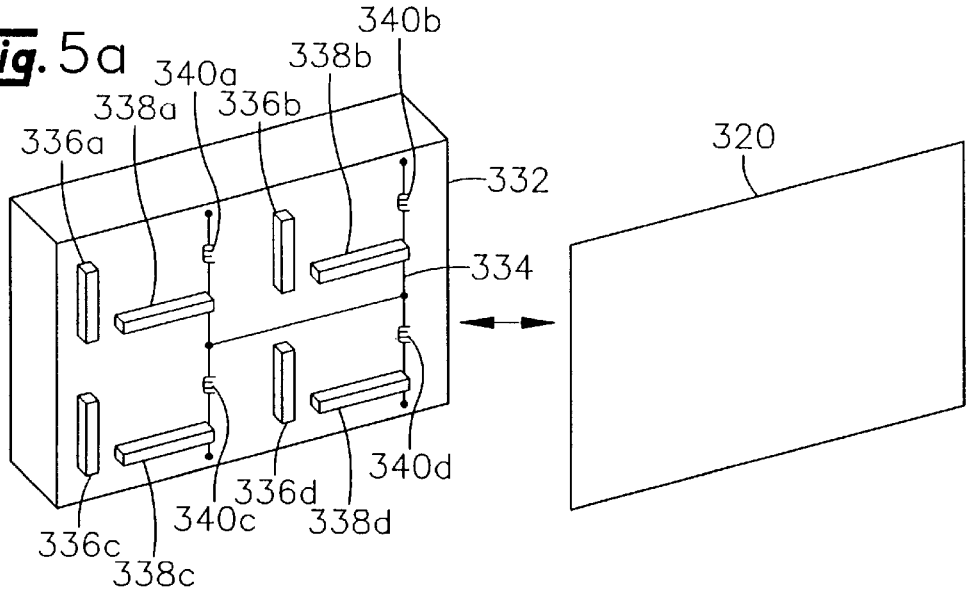
FIGS. 5*a–e* show a schematized plan view of an embodiment of the method including the use of a glue machine and a die press.
Figure 5C:
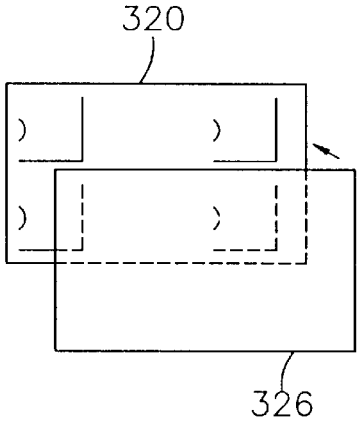
Figure 5B:
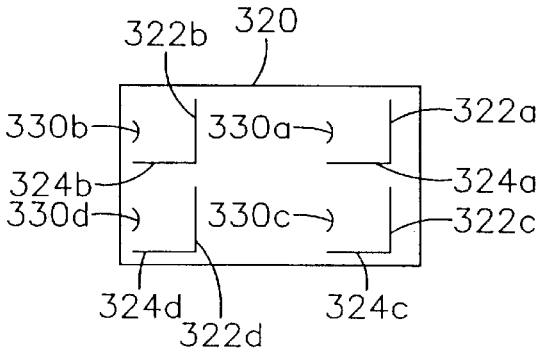
Figure 5D:
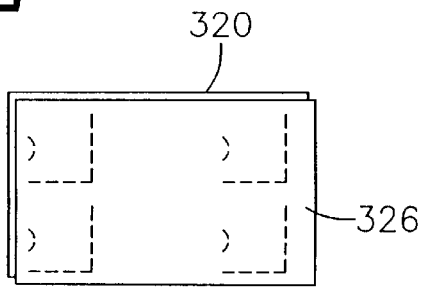
Figure 5E:
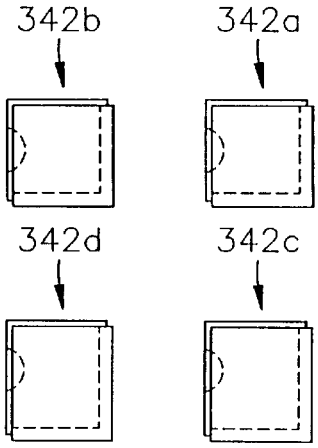

FIGS. 5*a–e* show the stages of the particular embodiment of the method that uses a glue pattern machine 332 and a die press 334 attached to the pattern machine 332. FIG. 5*a* shows a schematic representation of the glue pattern machine 332 including schematic representations of horizontal gluing elements 338*a–d* and vertical gluing elements 336*a–d*. The glue pattern machine can also have the die press 334 attached to it, which is again shown schematically in FIG. 5*a*. The die press 334 has tear line creating elements 340*a–d*. The glue pattern machine can be a device such as the Husky silk-screen pattern glue press. The die press can be a perforating machine such as the Johannesburg die press. The glue machine 332 and the die press 334 are brought into contact with the large bottom sheet, thereby contemporaneously depositing the horizontal glue strips 324*a–d* and the vertical glue strips 322*a–d* and creating the tear lines 330*a–d* as shown in FIG. 5*b*. The large bottom sheet 320 is then bonded to the large top sheet 326 as shown in FIG. 5*c* and 5*d*. The large bottom sheet 320 and the large top sheet 326 must have identical dimensions if the Husky silk-screen pattern glue press and the Johannesburg die press are used. The large joined top and bottom sheets 320 and 326 are then cut horizontally and vertically to produce the plurality of small sheet pairs 342*a–d* shown in FIG. 5*e*.

Figure 6:
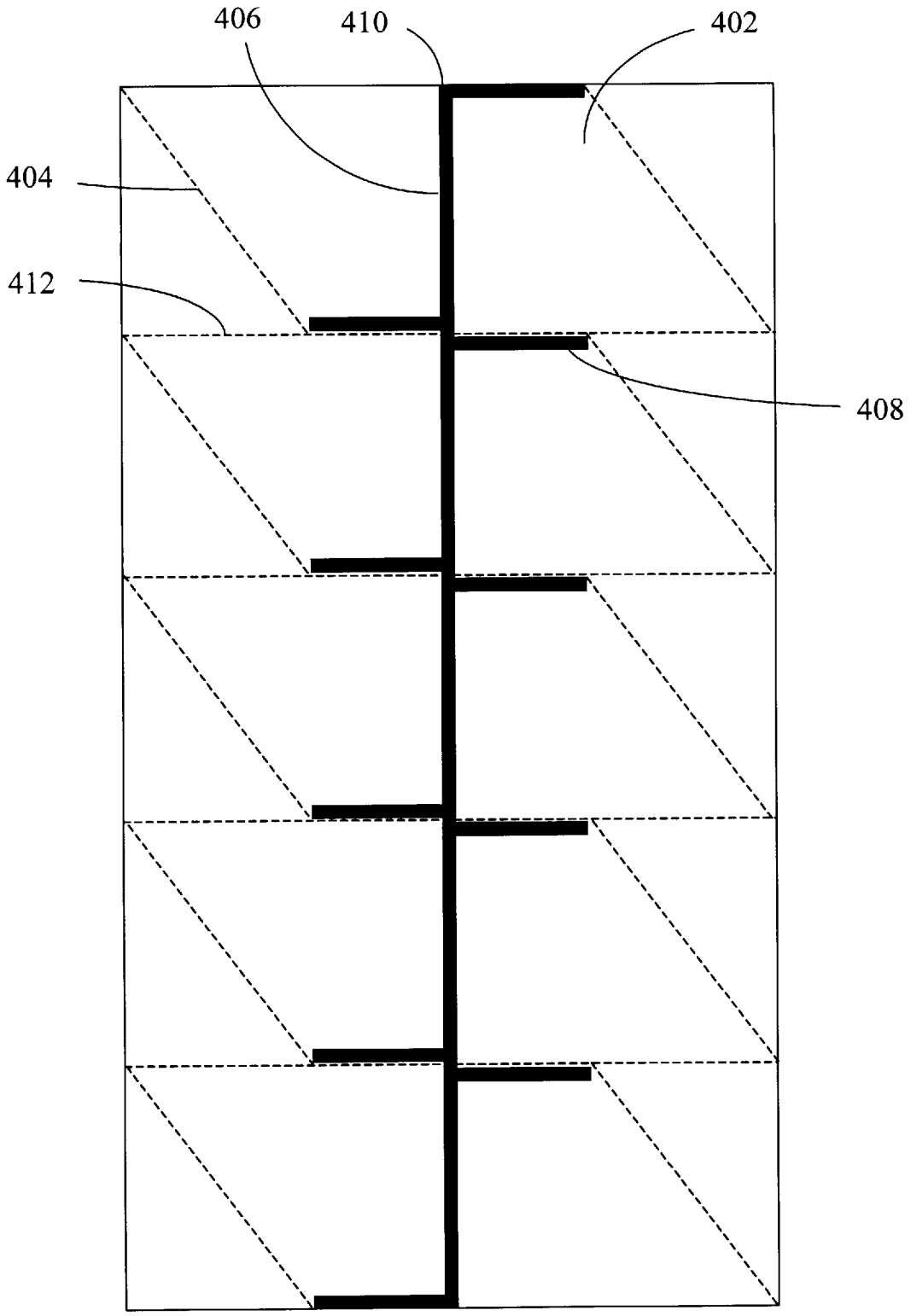
FIG. 6 shows a front view of the large sheet with glue strips attached.

FIG. 6 shows the most preferred arrangement of horizontal glue strips 406 and vertical glue strips 408 that are attached to the large bottom sheet 402. Also shown is the most preferred arrangement of the tear lines 404, horizontal cut-line 410, and vertical cut-lines 412. As can be seen from FIG. 6, it is preferred that ten small sheets be cut from a single sheet. Also, it can be seen that preferably the cuts are made directly between the sheet pair edges so that none of the large bottom and top sheets are wasted. The horizontal cut-line 410 passes through the center of the linear and closely spaced horizontal glue strips 406. The arrangement of the tear lines 404, horizontal glue strips 406, and vertical glue strips 408 are such that the small back sheets are arranged bottom edge to bottom edge and right edge to left edge on the large bottom sheet 402 before the vertical and horizontal cuts are made. From this pattern of ten small sheets, it can be seen that ten small sheet assemblies can be quickly and simultaneously produced rather than one at a time being slowly produced, as has been the case with the prior art.

Variations in the embodiments of the sheet assembly and the embodiments of the method for making the sheet assembly are possible without departing from the scope of this invention. The preceding description is intended to be illustrative of the preferred embodiments only. The true spirit and scope of the invention is to be determined by reference to the appended claims.

What is claimed is:

1. A sheet assembly comprising:

a rectangularly shaped front sheet of rigid material having horizontal and vertical edges, and front and rear surfaces;

a rectangularly shaped back sheet of rigid material having horizontal and vertical edges, and front and rear surfaces;

a tear line extending from a point on an edge of the back sheet, into an interior portion of the back sheet, and terminating at another point on an edge of the back sheet;

a removable flap formed in the back sheet by the tear line;

a pocket formed by the front sheet and a portion of the back sheet, the pocket including that portion of the back sheet disposed on the opposite side of the tear line from the flap so that the pocket may be further formed by tearing the back sheet along the tear line and removing the flap from the back sheet;

a bonded vertical edge formed by an adhesive disposed in a generally elongate rectangular strip positioned parallel and adjacent to one of the vertical edges of the front and back sheets, between the back surface of the front sheet and the front surface of the back sheet, and on the opposite side of the tear line from the flap;

a bonded horizontal edge formed by an adhesive disposed in a generally elongate rectangular strip positioned parallel and adjacent to one of the horizontal edoes of the front and back sheets and between the back surface of the front sheet and the front surface of the back sheet; and the pocket being formed between the bonded left and bottom edges and the tear line.

2. The sheet assembly of claim 1, further comprising:

a set of rectangularly shaped stacked pages of a flexible material having horizontal and vertical edges, and top and bottom surfaces; and means for binding the front sheet, the back sheet, and the set of pages together along an edge of each page, an edge of the front sheet, and an edge of the back sheet not forming a part of the flap.

3. The sheet assembly of claim 2, wherein the front sheet, the back sheet, and the set of pages are bound along a portion of one vertical edge;

another vertical edge of the back sheet is bonded from a point proximate to one horizontal edge to a point approximately halfway between another horizontal edge and the one horizontal edge; and the tear line linearly extends from a point on one vertical edge just above the adhesive to the corner between a horizontal edge and the other vertical edge.

4. The sheet assembly of claim 3, wherein the front sheet has a linear arrangement of holes substantially parallel and proximate to the right edge;

the back sheet has a linear arrangement of holes substantially parallel and proximate to the right edge and disposed on the opposite side of the tear line from the flap;

the set of pages has a linear arrangement of holes substantially parallel and proximate to the right edge; and the means for binding the front sheet, the back sheet, and the set of pages includes a wire spiraled through the linear arrangements of holes in the front sheet, the back sheet, and the set of pages.

5. The sheet assembly of claim 3, wherein the means for binding the front sheet, the back sheet, and the set of pages includes a tape strip bonded to a portion of the front surface of the front sheet, extended along a portion of the right edge of the front sheet and the back sheet, across a portion of the right edge of the set of pages and bonded to a portion of the back surface of the set of pages.

6. The sheet assembly of claim 2, wherein the front sheet, the back sheet, and the set of pages are bound along a portion of the top edge of the front sheet, the back sheet, and the set of pages; and the tear line extends from a point on the right edge, into an interior portion, and terminates on another point on the right edge.

7. The sheet assembly of claim 6, wherein the front sheet has a linear arrangement of holes substantially parallel and proximate to the top edge;

the back sheet has a linear arrangement of holes substantially parallel and proximate to the top edge;

the set of pages has a linear arrangement of holes substantially parallel and proximate to the top edge; and the means for binding the front sheet, the back sheet, and the set of pages includes a wire spiraled through the linear arrangements of holes in the front sheet, the back sheet, and the set of pages.

8. The sheet assembly of claim 6, wherein the means for binding the front sheet, the back sheet, and the set of pages includes a tape strip bonded to a portion of the front surface of the front sheet, extended along a portion of the top edge of the front sheet and the back sheet, across a portion of the top edge of the set of pages and bonded to a portion of the back surface of the set of pages.

9. A method for making multiple sheet assemblies comprising:

depositing on a front surface of a large bottom sheet of rigid material a plurality of spaced-apart, substantially parallel, horizontal glue strips extending between the vertical edges of the bottom sheet;

depositing on the front surface of the bottom sheet a plurality of spaced-apart, substantially parallel, vertical glue strips extending between the horizontal edges of the bottom sheet;

bonding a rear surface of a large top sheet of rigid material to the front surface of the bottom sheet by contacting the rear surface of the top sheet to the horizontal and vertical glue strips;

cutting the large bonded top and bottom sheets horizontally and vertically to produce a plurality of small joined rectangular sheet pairs, the cutting step including cutting vertically proximate to the vertical glue strips and horizontally proximate to the horizontal glue strips, each small sheet pair having a small front sheet, a small back sheet, a horizontal glue strip bonding a horizontal edge, and a vertical glue strip bonding a vertical edge; and creating a tear line in each small back sheet by beginning each tear line at a point with no glue on an edge of each back sheet, extending each tear line into an interior portion of each back sheet, and terminating each tear line at a point with no glue on an edge of each back sheet, each tear line forming a removable flap in each small back sheet, and the bonded edges and the tear line in each small sheet pair forming a pocket in each small sheet pair.

10. The method for making multiple sheet assemblies of claim 9, further comprising:

forming sets of stacked rectangular pages each having top and bottom surfaces and top, bottom, right, and left edges; and binding each of the small sheet pairs and each set of pages together along an edge of each page in the set, an edge of each small front sheet, and an edge of each small back sheet not receiving a tear line.

11. The method for making multiple sheet assemblies of claim 10, further comprising:

cutting the large bonded top and bottom sheets, with the cutting step also including cutting horizontally to produce a plurality of small joined rectangular sheet pairs having glue along only a portion of the vertical edge and terminating below the top edge of the small back sheet;

creating a tear line in each small back sheet by beginning each tear line at a point above the vertical glue strip on the small back sheet, extending the tear line diagonally across the small back sheet, and terminating each tear line at the corner between a top horizontal edge and a right vertical edge of the small back sheet; and binding each of the small sheet pairs and each set of pages together along a right vertical edge of each page in the set, a right vertical edge of each small front sheet, and the right vertical edge of each small back sheet below the tear line.

12. The method for making multiple sheet assemblies of claim 11, further comprising:

binding each of the small sheet pairs and each set of pages by creating a linear arrangement of holes substantially parallel and proximate to a right vertical edge of each small joined sheet pair and each set of pages, and spiraling a wire into a position within the linear arrangement of holes.

13. The method for making multiple sheet assemblies of claim 11, further comprising:

binding each small sheet pair and each set of pages by placing a strip of tape onto a portion of the front surface of the small front sheet, across the right vertical edge of the small joined sheet pair and the set of pages, and onto a portion of the back surface of the set of pages.

14. The method for making multiple sheet assemblies of claim 10, further comprising:

creating the tear line in each small back sheet by beginning each tear line at a point on a right vertical edge and extending the tear line into an interior portion of each back sheet, and terminating each tear line at another point on the right vertical edge; and binding each of the small sheet pairs and each set of pages together along a top horizontal edge of each page in the set, a top horizontal edge of each small front sheet, and a top horizontal edge of each small back sheet.

15. The method for making multiple sheet assemblies of claim 14, further comprising:

binding each small sheet pair and each set of pages by creating a linear arrangement of holes substantially parallel and proximate to the top horizontal edge of each small joined sheet pair and each set of pages, and spiraling a wire into a position within the linear arrangement of holes.

16. The method for making multiple sheet assemblies of claim 14, further comprising:

binding each small sheet pair and each set of pages by placing a strip of tape onto a portion of the front surface of the small front sheet, across the top horizontal edge of the small joined sheet pair and the set of pages, and onto a portion of the back surface of the set of pages.

17. The method for making multiple sheet assemblies of claim 10, further comprising:

using large top and bottom sheets having identical dimensions;

using a glue pattern machine to deposit the horizontal glue strips and the vertical glue strips on the large bottom sheet; and using a die press to create the tear lines in each back sheet.

18. The method for making multiple sheet assemblies of claim 9, further comprising:

using large top and bottom sheets having identical dimensions;

using a glue pattern machine to deposit the horizontal glue strips and the vertical glue strips on the large bottom sheet; and using a die press to create the tear lines in each back sheet.

19. The method for making multiple sheet assemblies of claim 9, further comprising: removing the removable flap from each small back sheet.

20. A sheet assembly comprising:

a rectangularly shaped front sheet of rigid material having horizontal and vertical edges, and front and rear surfaces;

a rectangularly shaped back sheet of rigid material having horizontal and vertical edges, and front and rear surfaces;

a recess formed along an edge of the back sheet extending into an interior portion of the back sheet;

a pocket formed by the front sheet and the back sheet;

a bonded vertical edge formed by an adhesive disposed in a generally elongate rectangular strip positioned parallel and adjacent to one of the vertical edges of the front and back sheets, between the back surface of the front sheet and the front surface of the back sheet;

a bonded horizontal edge formed by an adhesive disposed in a generally elongate rectangular strip positioned parallel and adjacent to one of the horizontal edges of the front and back sheets and between the back surface of the front sheet and the front surface of the back sheet; and the pocket being formed between the bonded horizontal and vertical edges and the recess.

* * * * *